US005547446A

United States Patent [19]

Szabo

[11] Patent Number: 5,547,446

[45] Date of Patent: Aug. 20, 1996

[54] EXERCISE DEVICE

[76] Inventor: William J. Szabo, 10126 Langmuir Ave., Sunland, Calif. 91040

[21] Appl. No.: 438,780

[22] Filed: May 11, 1995

[51] Int. Cl.[6] ..... A63B 21/02

[52] U.S. Cl. ..... 482/121; 482/122; 482/125; 482/126

[58] Field of Search ..... 482/121, 122, 482/125, 126

[56] References Cited

U.S. PATENT DOCUMENTS

| | | | |
|---|---|---|---|
| 2,855,198 | 10/1958 | King . | |
| 3,819,177 | 6/1974 | Spiro . | |
| 3,966,204 | 6/1976 | Dubach . | |
| 4,371,162 | 2/1983 | Hartzell . | |
| 4,376,533 | 3/1983 | Kolbel . | |
| 4,492,376 | 1/1985 | Schatz et al. . | |
| 4,783,067 | 11/1988 | Palmer . | |
| 4,793,609 | 12/1988 | Coutts et al. | 482/122 |
| 4,982,958 | 1/1991 | Ullman . | |
| 5,029,850 | 7/1991 | van Straaten | 482/122 |
| 5,078,388 | 1/1992 | Dempsey, Jr. . | |
| 5,314,396 | 5/1994 | Parr | 482/122 |

*Primary Examiner*—Lynne A. Reichard
*Attorney, Agent, or Firm*—Sand & Sebolt

[57] ABSTRACT

An exercise device for performing a variety of resistance exercises for toning various parts of the body. A rigid one-piece frame member has a substantially "H"-shaped configuration with a central support and two pairs of outwardly extending spaced parallel rails or leg members terminating in outer open ends. Elastic bands extend between the spaced rails and across the end openings. A user performs various arm and leg exercises by selectively pushing in or pulling out on the bands.

8 Claims, 2 Drawing Sheets

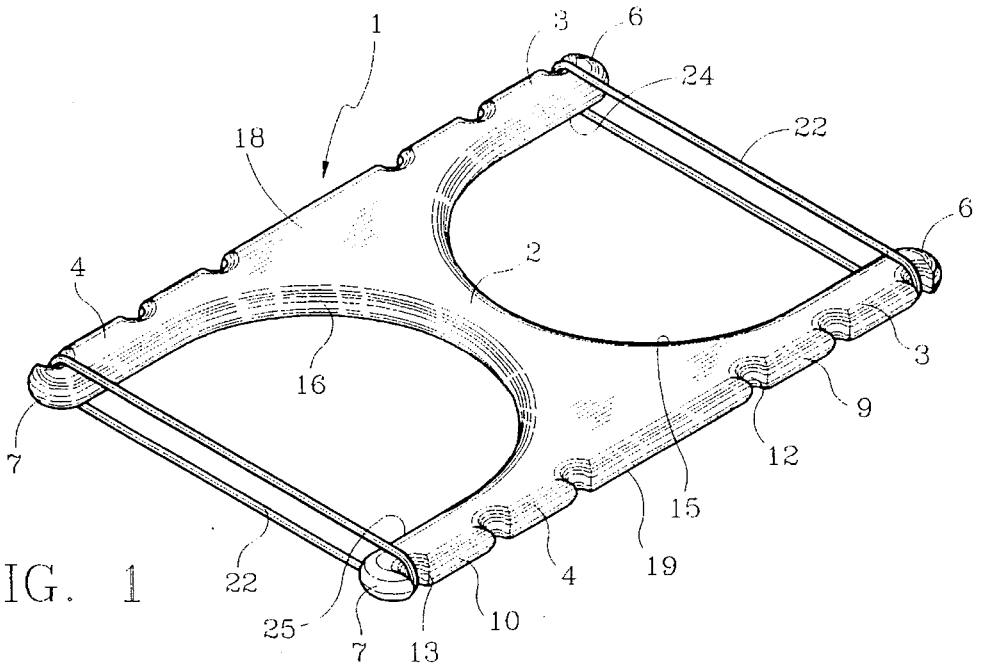
FIG. 1
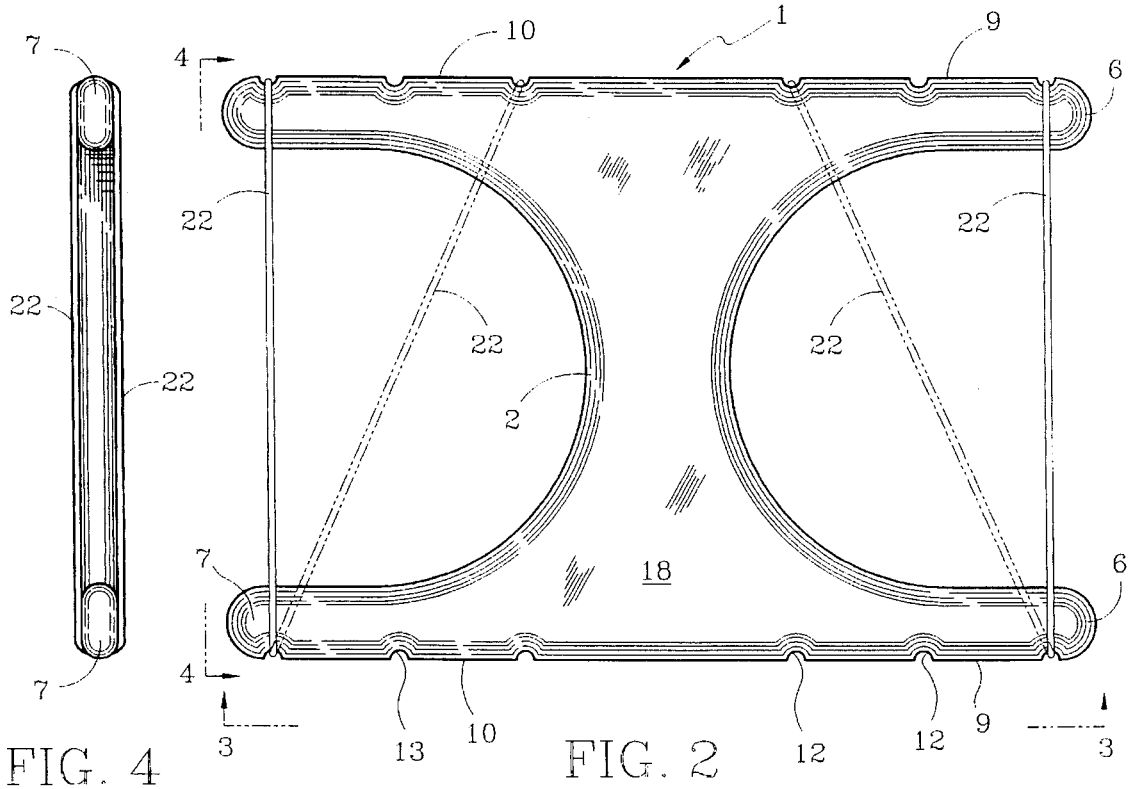
FIG. 4
FIG. 2
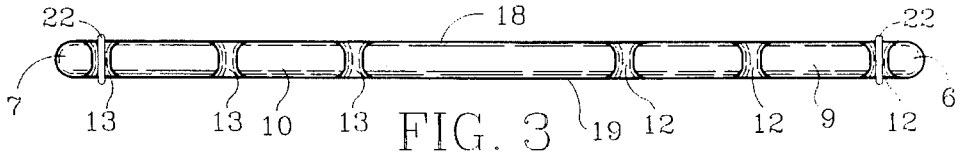
FIG. 3

EXERCISE DEVICE

BACKGROUND OF THE INVENTION

1. Technical Field

The invention relates to exercising equipment, and, in particular, to a portable, lightweight device for performing various toning exercises for the upper and lower portions of the body. More particularly, the invention relates to such an exercise device using elastic bands which provide resistance for both inward and outward movement of the user's limbs.

2. Background Information

Various types of exercising devices have been developed which use elastic elements that are stretched to provide resistance to develop various muscle groups of the human body. Some examples of such elastic resistance-type exercise devices are shown in U.S. Pat. Nos. 3,819,177, 3,966,204, 4,371,162, 4,376,533, 4,492,376, 4,783,067, 4,982,958 and 5,087,388. Most of these prior art devices are intended to develop a particular part of the human body, such as the hands, upper arms, back or legs, by pulling outwardly on the elastic bands. Although these devices are satisfactory for their intended purpose, they are limited as to the particular muscle groups which they affect. Likewise, some of these prior art devices are very bulky and cumbersome to use, and cannot be carried with an individual, such as in a suitcase, while travelling. Furthermore, many of these prior art devices are expensive to mass produce and require a number of components which must be separately manufactured and then assembled.

Therefore, the need exists for an improved exercise device which is of an extremely light weight, yet strong and durable, and is of a sufficient size and weight enabling the device to be carried easily in a suitcase or stored in a small place when not in use, which will enable the user to develop many of the major muscle groups.

SUMMARY OF THE INVENTION

Objectives of the invention include providing an exercise device which enables various parts of the body and various muscle groups to be toned and strengthened.

Another objective of the invention is to provide such a device in which both the inner and outer thighs and hips of a person can be toned and strengthened, either by pushing in or pulling out on elastic resistance elements of the device, and various parts of the upper torso can be strengthened, either by pushing in or pulling out on the elastic resistance elements.

A still further objective of the invention is to provide such a device which can be mass produced relatively inexpensively as a one-piece member of high-strength plastic, and in which the resistance can be provided by a plurality of elastic bands, such as latex rubber tubing.

A further objective of the invention is to provide such a device which is free of sharp corners or protrusions which could cause injury to the user or damage to the surrounding in which the device is being used.

Another objective of the invention is to provide such a device which is a sturdy, durable, lightweight, inexpensive structure, and which achieves the stated objectives in a simple, yet effective manner.

These objectives and advantages are obtained by the exercise device of the present invention, the general nature of which may be stated as including a rigid frame member having a central support and a pair of spaced-apart rails extending outwardly from opposite portions of said central support; and elastic band means extending between the respective spaced rails of each pair of rails for use in performing various exercises by the exerciser selectively pushing in and pulling out on one or both of said band means.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 1 is a perspective view of the exercise device of the present invention;

FIG. 2 is a plan view of the exercise device of FIG. 1;

FIG. 3 is an end elevational view looking in the direction of arrows 3—3, FIG. 2;

FIG. 4 is an end elevational view looking in the direction of arrows 4—4, FIG. 2.

Similar numerals refer to similar parts throughout the drawings.

DESCRIPTION OF THE PREFERRED EMBODIMENT

Figure 5C:
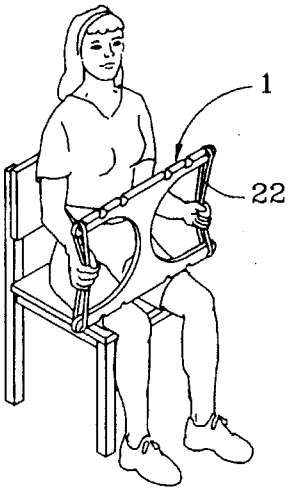
FIGS. 5*a*–5*e* are diagrammatic perspective views showing certain of the exercises to be performed with the device of FIGS. 1–4.

The exercise device of the present invention is indicated generally at 1, and is shown in FIGS. 1–4. Device 1 is an integral one-piece member, preferably injection molded, of a high-strength plastic material. However, if desired, the device could be blow formed having hollow interiors connected by reinforcing members (not shown), if desired, without affecting the concept of the invention.

Device 1 has a substantially "H"-shaped configuration, as shown particularly in FIGS. 1 and 2, and includes a main central frame member 2 which corresponds to the cross member of the "H", and two pairs of spaced side rails 3 and 4 extending substantially perpendicularly outwardly from frame member 2. Side rail pairs 3 and 4 extend generally parallel to each other throughout an outer portion of their length and terminate in rounded ends 6 and 7, respectively. Rails 3 and 4 each have outer edges 9 and 10, respectively, which extend parallel to each other. Edges 9 and 10 are formed with a plurality of slots or attachment grooves 12 and 13, respectively. The individual grooves of each rail preferably align with corresponding grooves in the opposed rail. The inner portions of rails 3 and 4 merge into frame member 2 by gradually smooth round corners 15 and 16, respectively, to provide a generally "U"-shaped configuration between each pair of rails and central frame member 2. Also, rails 3 and 4 and frame member 2 are provided with curved tapered edge areas which merge with opposed flat opposite surfaces 18 and 19 of frame member 2.

A plurality of elastic bands 22 are received in selected grooves 12 and 13 of the frame rails, and extend across open ends 24 and 25 of device 1, formed between the pair of rails 3 and 4, respectively. Elastic bands 22 may be formed of various materials, such as hollow latex rubber tubes or other types of elastic materials without affecting the concept of the invention. The manner of use of exercise device 1 is illustrated in FIGS. 5*a*–5*e* and is described below.

Figure 5B:
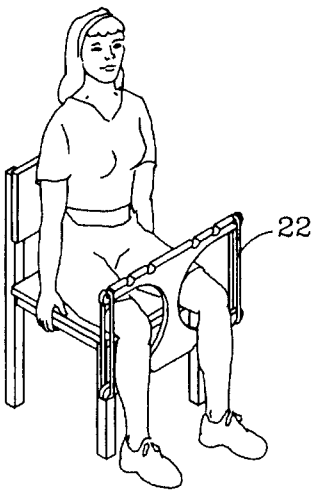
Figure 5A:
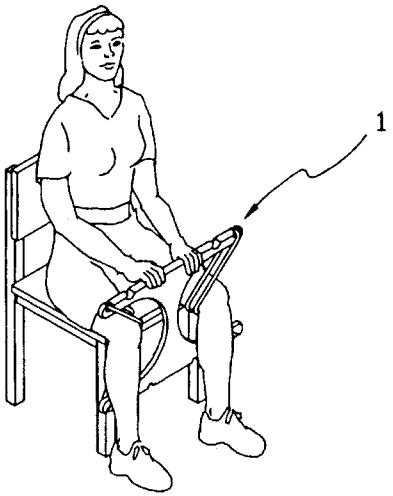

FIG. 5*a* shows exercise device 1 being used to strengthen the inner thighs. The user will place at least two of the bands in a selected pair of notches, as shown in solid lines in FIGS. 1 and 2, and then the user, by pressing inwardly with the sides of the quadriceps, will stretch the bands inwardly, as shown, to strengthen the inner thighs. In order to strengthen the outer thighs, the user will place his or her legs between bands 22 and central frame 2, as shown in FIG. 5*b*, and by repeatedly spreading the legs apart and moving the bands outwardly with the quadricep areas of the legs, it will strengthen the outer thighs of the user. The calf area of the legs can be strengthened by moving the device from the positions shown in FIGS. 5*a* and 5*b* to adjacent the calves. Although the drawings only show a single band being used on each side of the device, it is understood that a plurality of bands can be placed in the same grooves, or in successive grooves, to increase the resistance.

Figure 5E:
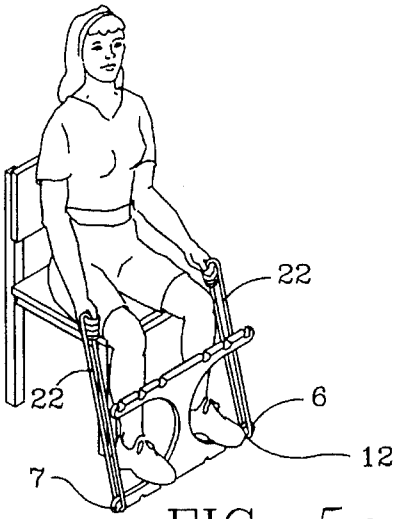
Figure 5D:
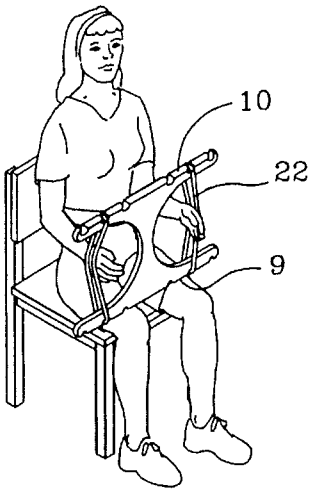

In order to strengthen the arms and shoulders the device will be used as shown in FIGS. 5*c* and 5*d*, where the user will either push in or pull out on the bands to strengthen the arms and shoulders, as shown. Again, a plurality of bands may be used, if increased resistance is desired. Various parts of the thighs and upper body can also be exercised by placing the bands diagonally, as shown in dot-dash lines in FIG. 2 for subsequent expansion and contraction.

Exercise device 1 could also be used as shown in FIG. 5*e*, where the user will sit on a chair and place his feet on the inside surfaces of the lower rails. The elastic bands are attached to each of the bottom rails, enabling the user to pull upwardly thereon with his arms either in a straight upward direction or in various inclined outward and inward directions for exercising additional portions of the upper body.

It is readily seen that FIGS. 5*a*–5*e* show only a portion of the various exercises that can be performed by device 1 to tone various parts and muscle groups of the body than just a single muscle or muscle group, as with many prior art exercise devices.

As shown in the drawings, end openings 24 and 25 of the device preferably have a size sufficient for enabling the quadricep areas of a person's leg to move inwardly toward central frame member 2. In the preferred embodiment, this opening extending between rounded ends 6 and 7 will be between 8 and 10 inches. In the preferred embodiment, the overall length measured between rounded edges 6 and 7 of each pair of rails is between 20 and 24 inches, with the overall height being between 12 and 14 inches. However, these dimensions can vary without effecting the concept of the invention. Also, these dimensions provide sufficient space between the elastic bands and frame member 2 to permit the inward movement of the bands as shown in FIGS. 5*a* and 5*c*, and provide for placement of a user's legs, as shown in FIG. 5*b*, not provided by known prior art devices.

Accordingly, the exercise device of the present invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise device is constructed and used, the characteristics of the construction, and the advantageous, new and useful results obtained; the new and useful structures, devices, elements, arrangements, parts and combinations, are set forth in the appended claims.

I claim:

1. An exercise device including:

a rigid frame member having an "H"-shaped configuration with a central support and two pairs of spaced-apart rails, each pair being immovably secured to and extending outwardly from opposite portions of said central support, each of said rails being formed with a plurality of grooves; and at least two elastic bands, each of which is removably mounted in selected grooves and extends between the respective spaced-apart rails of each pair of rails for use in performing various exercises by an exerciser selectively pushing in and pulling out said bands.

2. The exercise device defined in claim 1 in which the rails of each of the spaced-apart rails have a spaced-apart relationship of between 12 and 14 inches so that the exerciser's quadriceps can move therebetween for pushing in and pulling out the bands.

3. The exercise device defined in claim 1 in which the spaced-apart rails have outer edges; and in which three grooves are formed in each of the outer edges.

4. The exercise device defined in claim 1 in which the rigid frame member is an integral one-piece member formed of plastic.

5. The exercise device defined in claim 1 in which each of the spaced-apart rails merges into the central support by smooth curved corners.

6. The exercise device defined in claim 1 in which each of the spaced-apart rails terminates in curved outer ends.

7. The exercise device defined in claim 6 in which the frame member has a length and a width, with said length being greater than the width, said width being measured across said curved outer ends.

8. An exercise device including:

a rigid one-piece frame member having a substantially "H"-shaped configuration with a central support and a pair of spaced-apart rails extending outwardly from opposite portions of said central support, wherein the frame member has a length in the range of between 20 and 24 inches, and a width in the range of between 12 and 14 inches; and elastic band means extending between the respective spaced rails of each pair of rails for use in performing various exercises by an exerciser selectively pushing in and pulling out on one or both of said elastic band means.

* * * * *